United States Patent [19]

Lee

[11] Patent Number: 5,051,661

[45] Date of Patent: Sep. 24, 1991

[54] PROTECTIVE CIRCUIT FOR FLUORESCENT LAMP STABILIZER

[76] Inventor: Sang-Woo Lee, 187-90 Yeonhee-Dong, Seodaemoon-Ku, Seoul, Rep. of Korea

[21] Appl. No.: 516,764

[22] Filed: Apr. 30, 1990

[30] Foreign Application Priority Data

Jan. 15, 1989 [KR] Rep. of Korea ..... 16869

[51] Int. Cl.[5] ..... H05B 37/02

[52] U.S. Cl. ..... 315/225; 315/219; 315/DIG. 7

[58] Field of Search ..... 315/225, 224, 219, 208, 315/DIG. 7; 363/134

[56] References Cited

U.S. PATENT DOCUMENTS 4,525,649 6/1985 Knoll ..... 315/DIG. 7
4,562,383 12/1985 Kerscher ..... 315/225
4,709,189 11/1987 Kuchii ..... 315/DIG. 7
4,723,098 2/1988 Grubbs ..... 315/DIG. 7
4,797,803 1/1989 Carroll ..... 363/134
4,949,013 8/1990 Zuchtnegel ..... 315/225

*Primary Examiner*—Eugene R. LaRoche
*Assistant Examiner*—A. Zarabian
*Attorney, Agent, or Firm*—Jones, Tullar & Cooper

[57] ABSTRACT

A protective circuit for a fluorescent lamp includes a stabilizer circuit for preventing breakdown of the lamp as it becomes worn. Known stabilizers are high speed switching circuits which can break down and become unstable in certain conditions to cause an on-off cycling of the lamp. This is prevented by a protective circuit, according to the present invention, which incorporates a thyristor connected to a blocking transistor. A sensing element triggers the thyristor in response to an abnormal voltage or in response to an overheated condition. The thyristor then activates a transistor to open the lamp control circuit and to prevent its reclosing, thereby holding the lamp off.

6 Claims, 2 Drawing Sheets

PROTECTIVE CIRCUIT FOR FLUORESCENT LAMP STABILIZER

BACKGROUND OF THE INVENTION

This invention is related to a discharge tube lighting device which is preheated by a cathode, such as a fluorescent lamp.

There has been developed and produced both in this and other countries an electronic lighting device having a stabilizer circuit therein. The stabilizer circuit is superior to a conventional core-type inductor stabilizer with respect to power saving and quick lighting. However, a fatal breakdown of the fluorescent lamp and its stabilizer circuit may be caused as the lamp is worn out or blackened.

That is, the opposite filaments for emitting electrons in the lamp are worn out nonuniformly and the current within the lamp may have a diode property according to the degree of blackening of the lamp because the fluorescent lamp is a discharge tube preheated by a cathode. In particular, unexpected characteristics may appear according to the kind, mixing rate, or pressure of the gas used in the tube.

The electronic stabilizer circuit is of a high frequency switching type wherein the switching state may become abnormal according to the degree of the blackening of the lamp, which corresponds to the circuit load. In this case the breakdown of the stabilizer may be caused by overcurrent and overheating of the elements.

For preventing the breakdown of the stabilizer, a stabilizer protective circuit is required. A known stabilizer protective circuit has the disadvantage that it is opened when the elements are overheated and then automatically closed when the elements cool down.

With this known protective circuit, when the elements are overheated without lighting of the fluorescent lamp, the circuit is opened and in sequence, the elements cool down, thus causing closure of the circuit. This repetitive overheating of the elements—opening of the circuit—cooling down of the elements—closing of the circuit can continue indefinitely whereby the fluorescent lamp twinkles continually at cooling intervals.

Even with fluorescent lamps constructed in this manner, no big problem has arisen in location having a low ceiling since replacement of the lamp is easily achieved. However, in places having a high ceiling as, for example, in a plant or factory, the replacement of one or two disabled fluorescent lamps among many is not easy. If the disabled lamps are left as they are, the stabilizers are overloaded.

SUMMARY OF THE INVENTION

An object of the present invention is to provide a stabilizer protective circuit for a fluorescent lamp wherein the lighting circuit is not closed automatically once the circuit is opened and in sequence, the elements cools down.

BRIEF DESCRIPTION OF THE DRAWINGS

The foregoing, and additional objects, features and advantages of the present invention will become apparent to those of skill in the art from the following more detailed description of preferred embodiments thereof, taken with the accompanying drawings, in which.

DETAILED DESCRIPTION OF THE INVENTION

Figure 1:
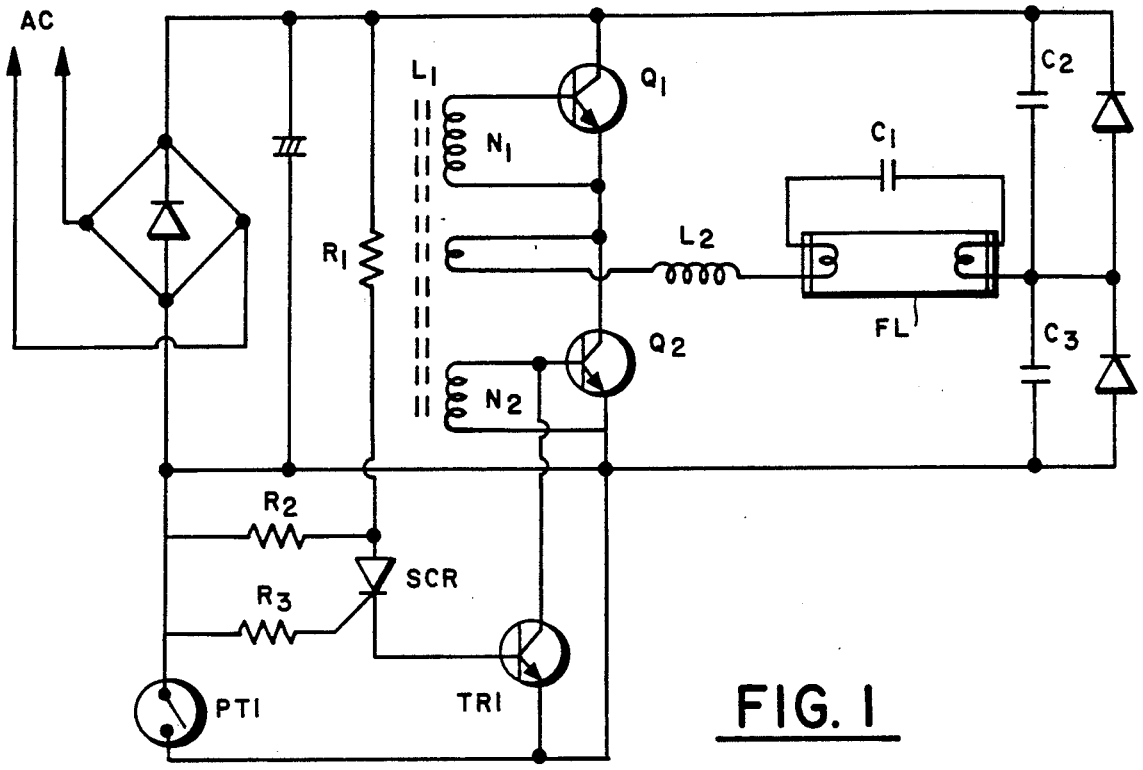
FIG. 1 is a circuit diagram of a stabilizer protective circuit of the present invention.

Referring to the drawings, two transistors $Q_1$ and $Q_2$ are connected in series with each other across a series electric source. At the connecting point of the two transistors $Q_1$ and $Q_2$, a first series resonant circuit comprising an inductor $L_2$ and a capacitor $C_1$ is constructed. A fluorescent lamp FL is connected across capacitor $C_1$ and in series with capacitors $C_2$ and $C_3$, whereby a second series resonant circuit is constructed. To the base of the transistors $Q_1$,$Q_2$ are connected respective secondary windings $N_1$, $N_2$ of a current transformer $L_1$, whereby the two transistors $Q_1$, $Q_2$ are on and off, in turn. With this arrangement, once the voltage applied to the base of the transistors $Q_1$, $Q_2$ is blocked, the transistors $Q_1$, $Q_2$ are not closed automatically.

FIG. 1 shows a circuit for blocking the voltage applied to the bases of the two transistors $Q_1$, $Q_2$.

Figure 2:
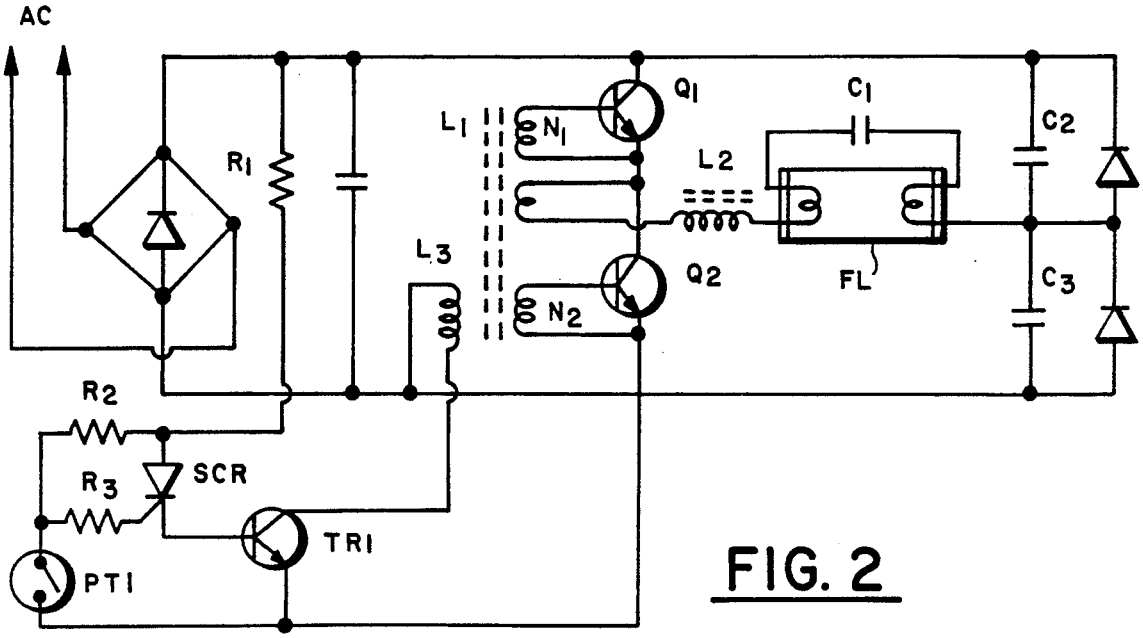
FIGS. 2 and 3 are circuit diagrams of other examples of the present invention.

FIG. 2 shows means for blocking the operation of the current transformer $L_1$ by adding a winding $L_3$ to the current transformer $L_1$ and connecting them together electrically. As means for operating these blocking circuits, a heat sensitive element as, for example, a bimetal switch $PT_1$ may be used as shown in FIGS. 1 and 2. Further, the blocking circuit may be operated by an abnormal voltage which is produced at the voltage applied to the lamp or to other parts of the circuit.

Figure 3:
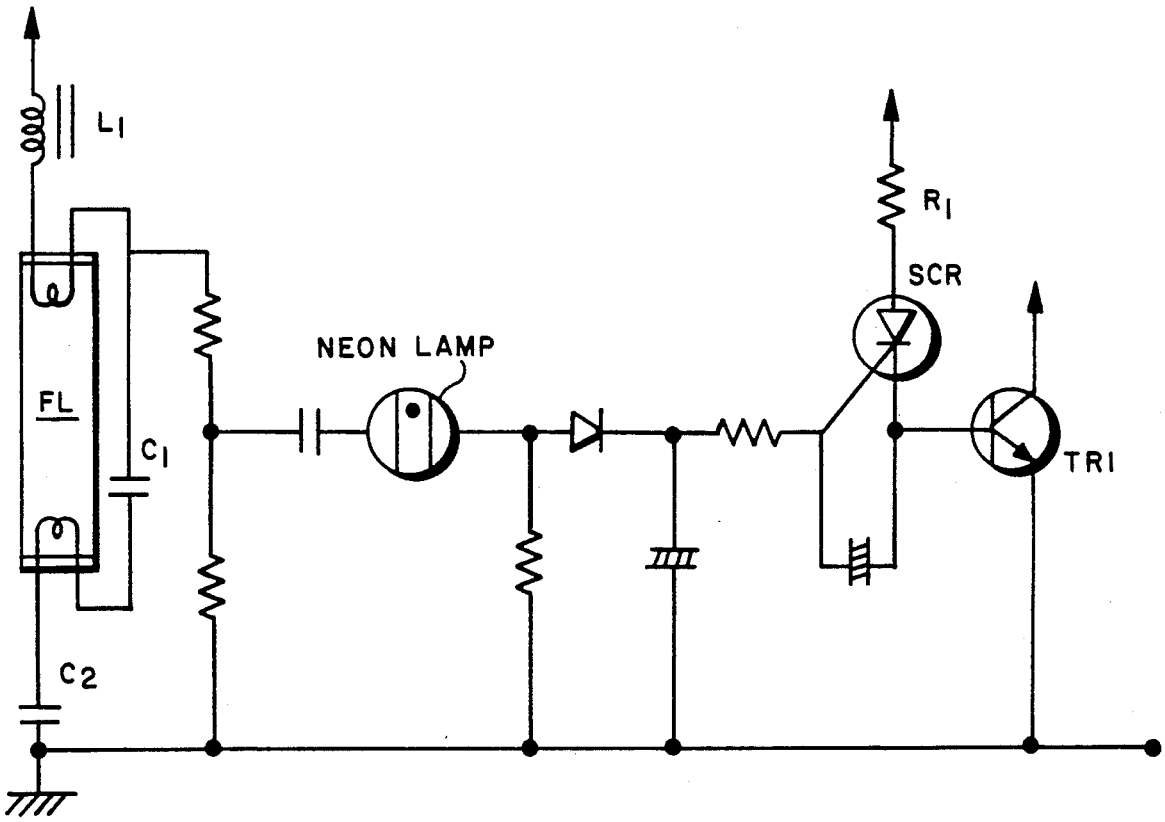

As illustrated in FIG. 1, for blocking the voltage applied to the base of the transistors $Q_1$, $Q_2$, the collector of transistor $TR_1$ is connected to one of the bases of the transistors $Q_1$, $Q_2$ and its emitter is grounded. To the base $TR_1$ is connected a cathode of a thyristor SCR to the gate of which is connected a switching element such as switch $PT_1$ as shown in FIGS. 1 and 2, or a Neon lamp, as shown in FIG. 3. An alternative connection of the blocking transistor $TR_1$ is shown in FIG. 2, wherein a transformer $L_3$ is added to the winding $L_1$ which supplies voltage to the transistors $Q_1$, $Q_2$. Winding $L_3$ is connected to the collector of TR1, whereby the voltage induced in the windings of transformer $L_1$ is blocked.

With this arrangement, an element sensitive to abnormal voltage or a heat sensitive element $PT_1$ act as a switching element electrically connected to cause trigger signal to be applied to the gate of the thyristor SCR to cause the thyristor and transistor $TR_1$ to be electrically connected with each other.

When thyristor SCR is conductive, it causes $TR_1$ to become conductive so that the transistors $Q_1$, $Q_2$ shown in FIG. 1 are cut off and current in the winding $N_2$ shown in FIG. 2 is cut off, both resulting in the voltage not being transmitted to the transistor $Q_2$. This opens the lighting circuit.

Once the thyristor is electrically connected to the transistor $TR_1$ causing the lighting circuit of the fluorescent lamp to be opened, the thyristor, due to the character thereof, maintains the electrically connected state. This holds the lighting circuit of fluorescent lamp open even if no further voltage is applied to the gate.

Accordingly, the protective circuit of the present invention is effective in opening and stabilizing the circuit in case overheating or overvoltage arises as the fluorescent lamp is worn out or the elements therein malfunction.

What is claimed is:

1. A protective circuit for a stabilizing circuit for a fluorescent lamp, comprising:

a d.c. power source;

first and second transistors connected in series across said power source;

an inductor and a first capacitor connected in series between a first connection point between said first and second transistors and a second connector point;

a fluorescent lamp connected across said first capacitor and having one end thereof connected to said second connector point;

second and third capacitors connected in series across said power source and having a junction point connected to said second connector point;

a transformer having first and second windings connected to base electrodes of said first and second transistors, respectively, to apply voltages thereto, whereby said transistors are alternately switched on and off;

blocking means connected to block the voltages applied to at least one of the base electrodes of said transistors;

a thyristor connected to said blocking means to control the operation thereof; and trigger means responsive to predetermined conditions to activate said thyristor.

2. The circuit of claim 1, wherein said trigger means is a switching element responsive to heat.

3. The circuit of claim 1, wherein said trigger means is a switching element responsive to voltage.

4. The circuit of claim 1 wherein said blocking means includes a winding on said transformer.

5. The circuit of claim 1, wherein said blocking means includes a third transistor controlled by said thyristor.

6. The circuit of claim 5, wherein said blocking means includes means connecting said third transistor to the base of one of said first and second transistors.

* * * * *